US007552981B1

(12) United States Patent
Tuniewicz et al.

(10) Patent No.: US 7,552,981 B1
(45) Date of Patent: Jun. 30, 2009

(54) LEFT AND RIGHT HAND CONVERTIBLE DOOR ENCLOSURE

(76) Inventors: Robert M. Tuniewicz, 14 Remsen Ct., Mt. Sinai, NY (US) 11766; Gilbert D. Talamo, P.O. Box 434, Great River, NY (US) 11739

( * ) Notice: Subject to any disclaimer, the term of this patent is extended or adjusted under 35 U.S.C. 154(b) by 428 days.

(21) Appl. No.: 11/430,220

(22) Filed: May 8, 2006

(51) Int. Cl.
*E05D 15/50* (2006.01)

(52) U.S. Cl. ..... 312/324; 312/329; 49/193; 16/231

(58) Field of Classification Search ..... 312/324, 312/326–329, 138.1; 16/230, 231; 49/193, 49/382; 292/DIG. 17, 303, 87
See application file for complete search history.

(56) References Cited

U.S. PATENT DOCUMENTS

| | | | | | |
|---|---|---|---|---|---|
| 600,318 | A * | 3/1898 | Pletcher | 16/232 |
| 865,191 | A * | 9/1907 | Lemp | 292/121 |
| 2,275,128 | A * | 3/1942 | Campbell | 16/232 |
| 2,790,992 | A * | 5/1957 | Campbell | 16/232 |
| 3,298,135 | A * | 1/1967 | Kinser | 49/380 |
| 3,733,749 | A * | 5/1973 | Parera | 49/193 |
| 4,466,676 | A * | 8/1984 | Nilsson | 312/283 |
| 4,503,582 | A * | 3/1985 | Gurubatham | 16/232 |
| 4,811,518 | A * | 3/1989 | Ladisa | 49/193 |
| 5,530,992 | A * | 7/1996 | Baermann | 16/231 |
| 5,829,197 | A * | 11/1998 | Oh | 49/193 |
| 6,003,716 | A * | 12/1999 | Allison et al. | 220/326 |
| 6,065,612 | A * | 5/2000 | Rinderer | 211/26 |
| 6,712,434 | B2 * | 3/2004 | Knab et al. | 312/265.4 |
| 6,827,230 | B1 | 12/2004 | Tuniewicz et al. | |
| 6,968,647 | B2 * | 11/2005 | Levesque et al. | 49/192 |
| 7,178,292 | B2 * | 2/2007 | Yamada | 49/193 |

* cited by examiner

*Primary Examiner*—Janet M Wilkens
(74) *Attorney, Agent, or Firm*—Richard L. Miller

(57) ABSTRACT

A left and right hand convertible door enclosure. An apparatus operatively connects to an enclosure and to a door so as to allow the door to convert between left and right hand. The apparatus includes a pair of front corners of a top wall of the enclosure having a pair of blind bores therein, respectively, a pair of side edges of the door being formed into a pair of tubes, respectively, a pair of front corners of a bottom wall of the enclosure having a pair of locking apparatuses, respectively, a pair of front edges of a pair of side walls of the enclosure being formed into a pair of recesses, respectively, and a hinge pin. The hinge pin enters one of the pair of tubes of the door and comes to rest in an associated blind bore in the top wall of the enclosure and in an associated locking apparatus on the bottom wall of the enclosure, depending upon the door being used as a right hand or a left hand.

18 Claims, 3 Drawing Sheets

LEFT AND RIGHT HAND CONVERTIBLE DOOR ENCLOSURE

BACKGROUND OF THE INVENTION

1. Field of the Invention

The present invention relates to an enclosure, and more particularly, the present invention relates to a left and right hand convertible door enclosure.

2. Description of the Prior Art

Numerous innovations for enclosures have been provided in the prior art that will be described. Even though these innovations may be suitable for the specific individual purposes to which they address, however, they differ from the present invention.

A FIRST EXAMPLE, U.S. Pat. No. 6,827,230 B1 issued on Dec. 7, 2004 to Tuniewicz et al. teaches a side opening rain tight electrical enclosure, including a box and a door pivotally and slidably mounted to the box by a hinge. The box has a front, a pair of side walls, and a top wall with a lip depending therefrom over, but slightly spaced away from, the front and the pair of side walls of the box so as to from a gap therebetween. The hinge allows the door to slide down relative to the box, pivot relative to the box onto the front of the box, and slide up relative to the box and be positioned in the gap for allowing the lip to prevent rain from entering behind the door. The box has a latch slidably mounted to the bottom wall thereof and extendable therefrom through the door so as to prevent the door from sliding back down relative to the box once closed.

It is apparent that numerous innovations for enclosures have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

Accordingly, it is an object of the present invention to provide a left and right hand convertible door enclosure that avoids the disadvantages of the prior art.

Briefly stated, another object of the present invention is to provide a left and right hand convertible door enclosure. An apparatus operatively connects to an enclosure and to a door so as to allow the door to convert between left and right hand. The apparatus includes a pair of front corners of a top wall of the enclosure having a pair of blind bores therein, respectively, a pair of side edges of the door being formed into a pair of tubes, respectively, a pair of front corners of a bottom wall of the enclosure having a pair of locking apparatuses, respectively, a pair of front edges of a pair of side walls of the enclosure being formed into a pair of recesses, respectively, and a hinge pin. The hinge pin enters one of the pair of tubes of the door and comes to rest in an associated blind bore in the top wall of the enclosure and in an associated locking apparatus on the bottom wall of the enclosure, depending upon the door being used as a right hand or a left hand.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

LIST OF REFERENCE NUMERALS UTILIZED IN THE DRAWING

Figure 1:
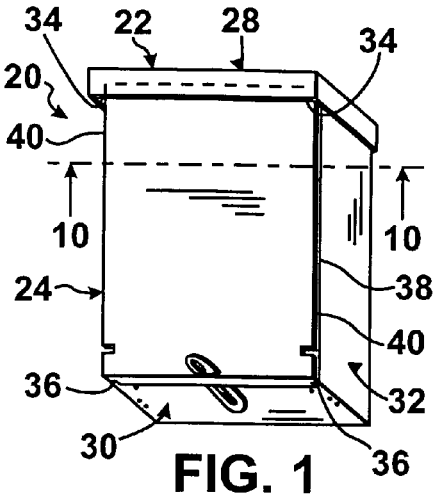
FIG. 1 is a diagrammatic perspective view of the left and right hand convertible door enclosure of the present invention with the door closed.

20 left and right hand convertible door enclosure of present invention
22 enclosure
24 door
26 apparatus
28 top wall of enclosure 22
30 bottom wall of enclosure 22
32 pair of side walls of enclosure 22
33 open front of enclosure 22
34 pair of front corners of top wall 28 of enclosure 22
36 pair of front corners of bottom wall 30 of enclosure 22
38 pair of front edges of pair of side walls 32 of enclosure 22, respectively

40 pair of side edges of door 24
42 pair of blind bores in pair of front corners 34 of top wall 28 of enclosure 22, respectively, of apparatus 26
44 pair of tubes formed in pair of side edges 40 of door 24, respectively, of apparatus 26
46 pair of locking apparatuses on pair of front corners 36 of bottom wall 30 of enclosure 22, respectively, of apparatus 26
48 pair of recesses formed by pair of front edges 38 of pair of side walls 32 of enclosure 22, respectively, of apparatus 26
50 hinge pin of apparatus 26
52 intermediate portion of hinge pin 50 of apparatus 26
54 upper terminus of hinge pin 50 of apparatus 26
56 lower terminus of hinge pin 50 of apparatus 26
58 foot formed from lower terminus 56 of hinge pin 50 of apparatus 26
60 blind slot in foot 58 formed from lower terminus 56 of hinge pin 50 of apparatus 26
62 stationary guide member of each locking apparatus of pair of locking apparatuses 46 of apparatus 26
64 flexible locking member of each locking apparatus of pair of locking apparatuses 46 of apparatus 26

DETAILED DESCRIPTION OF THE PREFERRED EMBODIMENT

Figure 2:
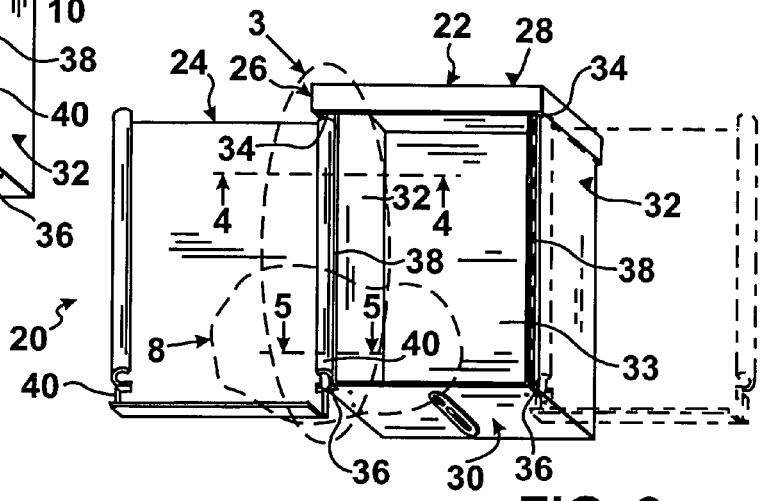
FIG. 2 is a diagrammatic perspective view of the left and right hand convertible door enclosure of the present invention with the door opened.

Referring now to the figures, in which like numerals indicate like parts, and particularly to FIGS. 1 and 2, which are, respectively, a diagrammatic perspective view of the left and right hand convertible door enclosure of the present invention with the door closed, and a diagrammatic perspective view of the left and right hand convertible door enclosure of the present invention with the door opened, the left and right hand convertible door enclosure of the present invention is shown generally at 20.

The left and right hand convertible door enclosure 20 comprises an enclosure 22, a door 24, and apparatus 26. The apparats 26 operatively connects to the enclosure 22 and to the door 24 so as to allow the door 24 to convert between left and right hand.

The enclosure 22 has a top wall 28, a bottom wall 30, and a pair of side walls 32. The top wall 28 of the enclosure 22, the bottom wall 30 of the enclosure 22, and the pair of side walls 32 of the enclosure 22 define an open front 33 of the enclosure 22.

The door 24 selectively closes the open front 33 of the enclosure 22.

The top wall 28 of the enclosure 22 has a pair of front corners 34, the bottom wall 30 of the enclosure 22 has a pair of front corners 36, the pair of side walls 32 of the enclosure 22 have a pair of front edges 38, respectively, and the door 24 has a pair of side edges 40.

The apparatus 26 involves the pair of front corners 34 of the top wall 28 of the enclosure 22, the pair of front corners 36 of the bottom wall 30 of the enclosure 22, the pair of front edges 38 of the pair of side walls 32 of the enclosure 22, respectively, and the pair of side edges 40 of the door 24.

Figure 3:
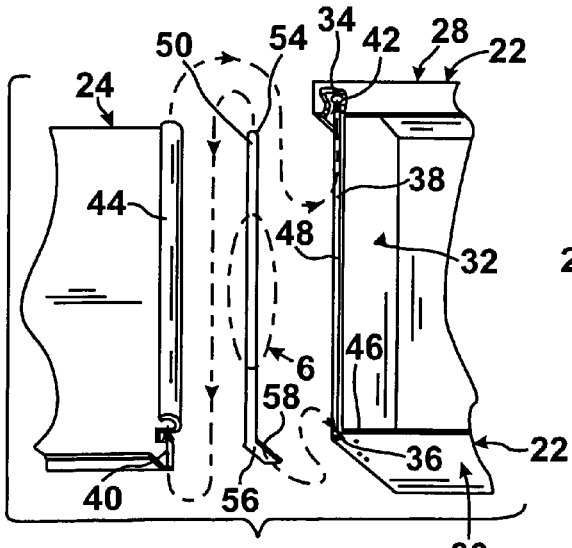
FIG. 3 is an enlarged exploded diagrammatic perspective view of the area generally enclosed by the dotted curve identified by ARROW 3 in FIG. 2 of the hinge apparatus of the left and right hand convertible door enclosure of the present invention.
Figure 4:
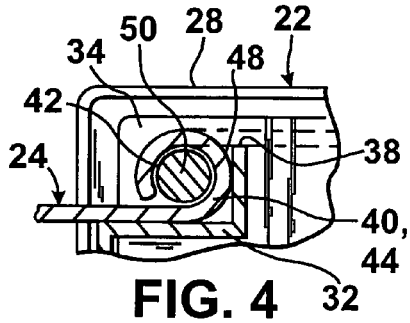
FIG. 4 is an enlarged diagrammatic cross sectional view taken along LINE 4-4 in FIG. 2 of the upper hinge point of the hinge apparatus of the left and right hand convertible door enclosure of the present invention.
Figure 5:
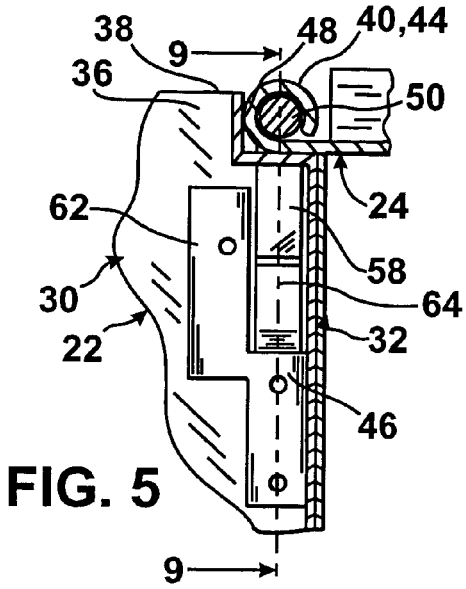
FIG. 5 is an enlarged diagrammatic cross sectional view taken along LINE 5-5 in FIG. 2 of the lower hinge point of the hinge apparatus of the left and right hand convertible door enclosure of the present invention.
Figure 6:
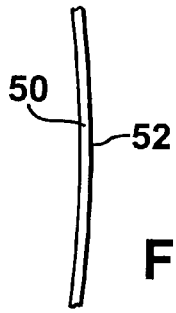
FIG. 6 is an enlarged diagrammatic perspective view of the area generally enclosed by the dotted curve identified by ARROW 6 in FIG. 3 of the hinge pin of the hinge apparatus of the left and right-hand convertible door enclosure of the present invention.
Figure 7:
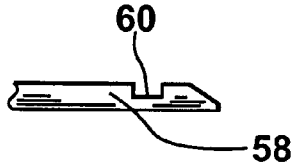
FIG. 7 is an enlarged diagrammatic top plan view of the foot of the hinge pin of the hinge apparatus of the left and right hand convertible door enclosure of the present invention identified by ARROW 7 in FIG. 3.
Figure 8:
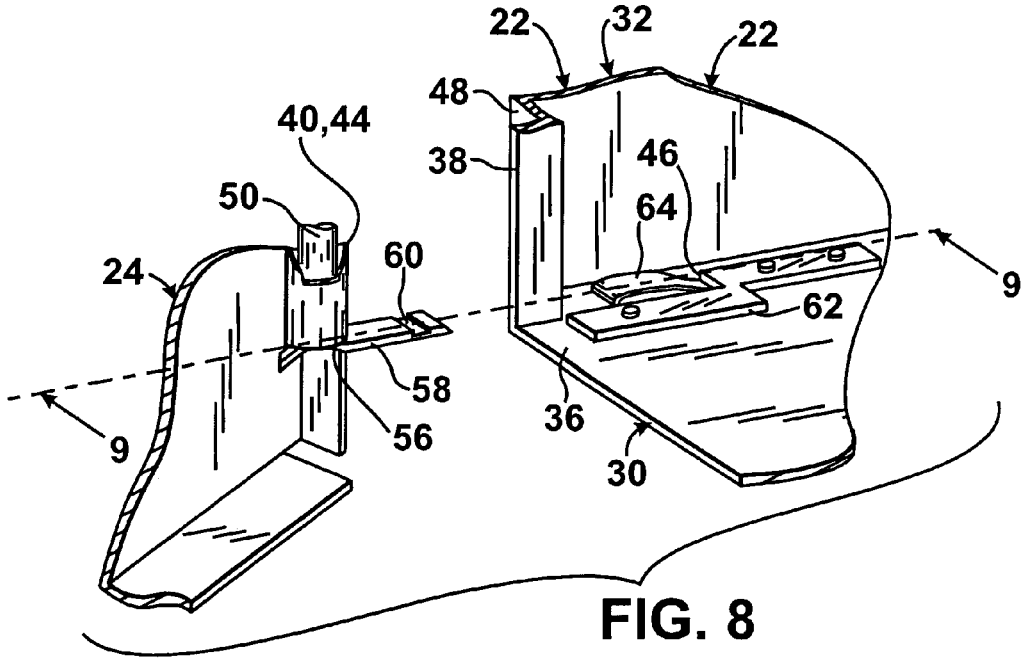
FIG. 8 is an enlarged exploded perspective view of the area generally enclosed by the dotted curve identified by ARROW 8 in FIG. 3 of the lower portion of the hinge apparatus of the left and right hand convertible door enclosure of the present invention.
Figure 9:
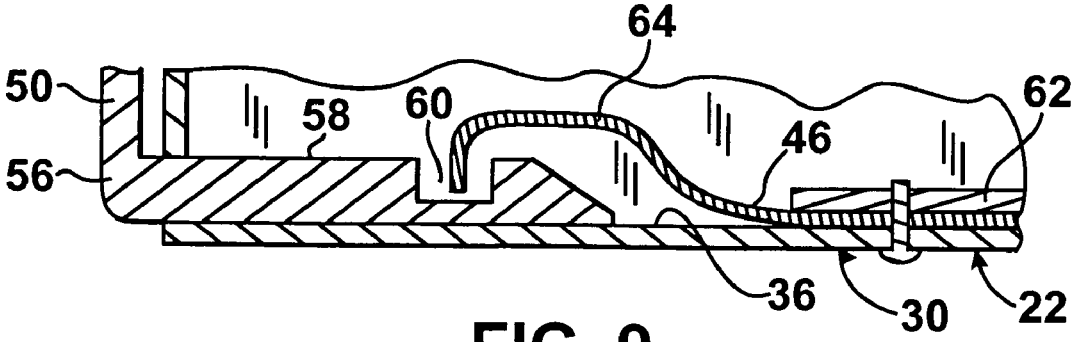
FIG. 9 is an enlarged diagrammatic cross sectional view taken along LINE 9-9 in both FIG. 5 and FIG. 8 of the lower portion of the hinge apparatus of the left and right hand convertible door enclosure of the present invention.
Figure 10:
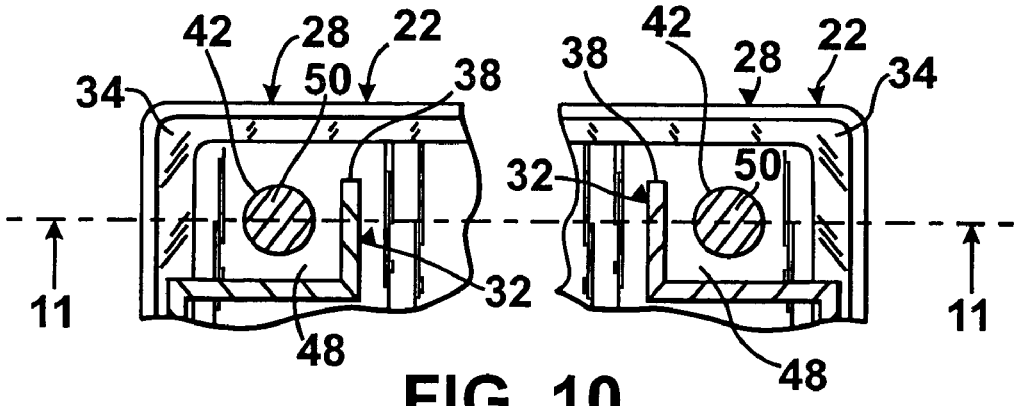
FIG. 10 is an enlarged diagrammatic cross sectional view taken along LINE 10-10 in FIG. 1 of the upper hinge points of the hinge appartus of the left and right hand convertible door enclosure of the present invention.
Figure 11:
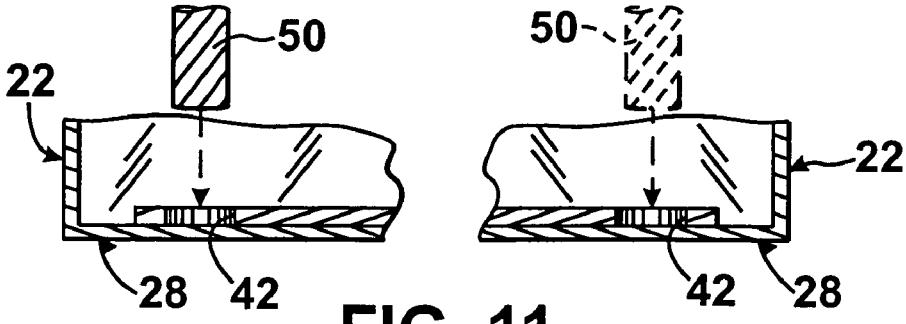
FIG. 11 is an exploded diagrammatic cross sectional view taken along LINE 11-11 in FIG. 10 of the upper hinge points of the hinge apparatus of the left and right hand convertible door enclosure of the present invention.

The configuration of the apparatus 26 can best be seen in FIGS. 3-11, which are, respectively, an enlarged exploded diagrammatic perspective view of the area generally enclosed by the dotted curve identified by ARROW 3 in FIG. 2 of the hinge apparatus of the left and right hand convertible door enclosure of the present invention, an enlarged diagrammatic cross sectional view taken along LINE 4-4 in FIG. 2 of the upper hinge point of the hinge apparatus of the left and right hand convertible door enclosure of the present invention, an enlarged diagrammatic cross sectional view taken along LINE 5-5 in FIG. 2 of the lower hinge point of the hinge apparatus of the left and right hand convertible door enclosure of the present invention, an enlarged diagrammatic perspective view of the area generally enclosed by the dotted curve identified by ARROW 6 in FIG. 3 of the hinge pin of the hinge apparatus of the left and right hand convertible door enclosure of the present invention, an enlarged diagrammatic top plan view of the foot of the hinge pin of the hinge apparatus of the left and right hand convertible door enclosure of the present invention identified by ARROW 7 in FIG. 3, an enlarged exploded perspective view of the area generally enclosed by the dotted curve identified by ARROW 8 in FIG. 3 of the lower portion of the hinge apparatus of the left and right hand convertible door enclosure of the present invention, an enlarged diagrammatic cross sectional view taken along LINE 9-9 in FIG. 5 of the lower portion of the hinge apparatus of the left and right hand convertible door enclosure of the present invention, an enlarged diagrammatic cross sectional view taken along LINE 10-10 in FIG. 1 of the upper hinge points of the hinge apparatus of the left and right hand convertible door enclosure of the present invention, and an exploded diagrammatic cross sectional view taken along LINE 11-11 in FIG. 10 of the upper hinge points of the hinge apparatus of the left and right hand convertible door enclosure of the present invention, and as such, will be discussed with reference thereto.

The apparatus 26 comprises the pair of front corners 34 of the top wall 28 of the enclosure 22 having a pair of blind bores 42 therein, respectively.

The apparatus 26 further comprises the pair of side edges 40 of the door 24 being formed into a pair of tubes 44, respectively.

The apparatus 26 further comprises the pair of front corners 36 of the bottom wall 30 of the enclosure 22 having a pair of locking apparatuses 46, respectively.

The apparatus 26 further comprises the pair of front edges 38 of the pair of side walls 32 of the enclosure 22 being formed into a pair of recesses 48, respectively.

The apparatus 26 further comprises a hinge pin 50. The hinge pin 50 enters one of the pair of tubes 44 of the door 24 and comes to rest in an associated blind bore 42 in the top wall 28 of the enclosure 22 and in an associated locking apparatus 46 on the bottom wall 30 of the enclosure 22, depending upon the door 24 being used as a right hand or a left hand.

The hinge pin 50 has an intermediate portion 52. The intermediate portion 52 of the hinge pin 50 is bowed so as to prevent it from dislodging from an associated tube 44 of the door 24 when the door 24 is removed from the enclosure 22 for changing between right and left hand.

The hinge pin 50 further has an upper terminus 54 and a lower terminus 56. The upper terminus 54 of the hinge pin 50 comes to rest in the associated blind bore 42 in the top wall 28 of the enclosure 22 and the lower terminus 56 of the hinge pin 50 comes to rest in the associated locking apparatus 46 on the bottom wall 30 of the enclosure 22, depending upon the door 24 being used as a right hand or a left hand.

The lower terminus 56 of the hinge pin 50 is formed into a foot 58. The foot 58 of the hinge pin 50 has a blind slot 60, and releasebly engages in the associated locking apparatus 46 on the bottom wall 30 of the enclosure 22, depending upon the door 24 being used as a right hand or a left hand.

Each locking apparatus 46 comprises a stationary guide member 62 and a flexible locking mmeber 64. The stationary guide member 62 of each locking apparatus 46 is disposed at each front corner 36 of the bottom wall 30 of the enclosure 22 and selectively receives the foot 58 of the hinge pin 50.

The flexible locking member 64 of each locking apparatus 46 extends from the stationary guide member 62 of an associated locking apparatus 46 and selectively engages in the blind slot 60 in the foot 58 of the hinge pin 50, thereby releasebly locking the foot 58 of the hinge pin 50 in the stationary guide member 62 of the associated locking apparatus 46, and to release the flexible locking member 64 of the locking apparatus 46 from the blind slot 60 in the foot 58 of the hinge pin 50 in order to remove the door 24, the flexible locking member 64 of the associated locking apparatus 46 is raised so as to disengage from the blind slot 60 in the foot 58 of the hinge pin 50, thereby allowing the foot 58 of the hinge pin 50 to be removed.

It will be understood that each of the elements described above, or two or more together, may also find a useful application in other types of constructions differing from the types described above.

While the invention has been illustrated and described as embodied in a left and right hand convertible door enclosure, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A left and right hand convertible door enclosure, comprising:

a) an enclosure;

b) a door; and c) apparatus;

wherein said apparatus operatively connects to said enclosure and to said door so as to allow said door to convert between left and right hand;

wherein said enclosure has a top wall;

wherein said enclosure has a bottom wall;

wherein said enclosure has a pair of side walls; and wherein said top wall of said enclosure, said bottom wall of said enclosure, and said pair of side walls of said enclosure define an open front of said enclosure;

wherein said top wall of said enclosure has a pair of front corners;

wherein said bottom wall of said enclosure has a pair of front corners;

wherein said pair of side walls of said enclosure have a pair of front edges, respectively; and wherein said door has a pair of side edges;

wherein said apparatus comprises said pair of front corners of said top wall of said enclosure having a pair of blind bores therein, respectively;

wherein said apparatus comprises said pair of side edges of said door being formed into a pair of tubes, respectively;

wherein said apparatus comprises said pair of front corners of said bottom wall of said enclosure having a pair of locking apparatuses, respectively;

wherein said apparatus comprises a hinge pin; wherein said hinge pin enters one of said pair of tubes of said door and comes to rest in an associated blind bore in said top wall of said enclosure and in an associated locking apparatus on said bottom wall of said enclosure, depending upon said door being used as a right hand or a left hand.

2. The left and right hand convertible door enclosure of claim 1, wherein said door selectively closes said open front of said enclosure.

3. The left and right hand convertible door enclosure of claim 1, wherein said apparatus involves said pair of front corners of said top wall of said enclosure;

wherein said apparatus involves said pair of front corners of said bottom wall of said enclosure;

wherein said apparatus involves said pair of front edges of said pair of side walls of said enclosure, respectively; and wherein said apparatus involves said pair of side edges of said door.

4. The left and right hand convertible door enclosure of claim 1, wherein said hinge pin has an upper terminus;

wherein said hinge pin has a lower terminus; and wherein said upper terminus of said hinge pin comes to rest in said associated blind bore in said top wall of said enclosure and said lower terminus of said hinge pin comes to rest in said associated locking apparatus on said bottom wall of said enclosure, depending upon said door being used as a right hand or a left hand.

5. The left and right hand convertible door enclosure of claim 4, wherein said lower terminus of said hinge pin is formed into a foot; and wherein said foot of said hinge pin releasably engages in said associated locking apparatus on said bottom wall of said enclosure, depending upon said door being used as a right hand or a left hand.

6. The left and right hand convertible door enclosure of claim 5, wherein said foot of said hinge pin has a blind slot.

7. The left and right hand convertible door enclosure of claim 6, wherein each locking apparatus comprises a stationary guide member; and wherein each locking apparatus comprises a flexible locking member.

8. The left and right hand convertible door enclosure of claim 7, wherein said stationary guide member of each locking apparatus is disposed at each front corner of said bottom wall of said enclosure; and wherein said stationary guide member of each locking apparatus selectively receives said foot of said hinge pin.

9. The left and right hand convertible door enclosure of claim 7, wherein said flexible locking member of each locking apparatus extends from said stationary guide member of an associated locking apparatus; and wherein said flexible locking member of each locking apparatus selectively engages in said blind slot in said foot of said hinge pin, thereby releasably locking said foot of said hinge pin in said stationary guide member of said associated locking apparatus, and to release said flexible locking member of said locking apparatus from said blind slot in said foot of said hinge pin in order to remove said door, said flexible locking member of said associated locking apparatus is raised so as to disengage from said blind slot in said foot of said hinge pin, thereby allowing said foot of said hinge pin to be removed.

10. A left and right hand convertible door enclosure, comprising:

a) an enclousre;

b) a door; and c) apparatus;

wherein said apparatus operatively connects to said enclosure and to said door so as to allow said door to convert between left and right hand;

wherein said enclousre had a top wall;

wherein said enclosure has a bottom wall;

wherein said enclosure has a pair of side walls; and wherein said top wall of said enclosure, said bottom wall of said enclosure, and said pair of side walls of said enclosure define an open front of said enclosure;

wherein said top wall of said enclosure has a pair of front corners;

wherein said bottom wall of said enclosure has a pair of front corners;

wherein said pair of side walls of said enclosure have a pair of front edges, respectively; and wherein said door has a pair of side edges;

wherein said apparatus comprises said pair of front corners of said top wall of said enclosure having a pair of blind bores therein, respectively;

wherein said apparatus comprises said pair of side edges of said door being formed into a pair of tubes, respectively;

wherein said apparatus comprises said pair of front corners of said bottom wall of said enclosure having a pair of locking apparatuses, respectively;

wherein said apparatus comprises a hinge pin;

wherein said hinge pin has an intermediate portion; and wherein said intermediate portion of said hinge pin is bowed so as to prevent it from dislodging from an associated tube of said door when said door is removed from said enclosure for changing between right and left hand.

11. The left and right hand convertible door enclosure of claim 10, wherein said hinge pin has an upper terminus;

wherein said hinge pin has a lower terminus; and wherein said upper terminus of said hinge pin comes to rest in said associated blind bore in said top wall of said enclosure and said lower terminus of said hinge pin comes to rest in said associated locking apparatus on said bottom wall of said enclosure, depending upon said door being used as a right hand or a left hand.

12. The left and right hand convertible door enclosure of claim 11, wherein said lower terminus of said hinge pin is formed into a foot; and wherein said foot of said hinge pin releasably engages in said associated locking apparatus on said bottom wall of said enclosure, depending upon said door being used as a right hand or a left hand.

13. The left and right hand convertible door enclosure of claim 12, wherein said foot of said hinge pin has a blind slot.

14. The left and right hand convertible door enclosure of claim 13, wherein each locking apparatus comprises a stationary guide member; and wherein each locking apparatus comprises a flexible locking member.

15. The left and right hand convertible door enclosure of claim 14, wherein said stationary guide member of each locking apparatus is disposed at each front corner of said bottom wall of said enclosure; and wherein said stationary guide member of each locking apparatus selectively receives said foot of said hinge pin.

16. The left and right hand convertible door enclosure of claim 14, wherein said flexible locking member of each locking apparatus extends from said stationary guide member of an associated locking apparatus; and wherein said flexible locking member of each locking apparatus selectively engages in said blind slot in said foot of said hinge pin, thereby releasebly locking said foot of said hinge pin in said stationary guide member of said associated locking apparatus, and to release said flexible locking member of said locking apparatus from said blind slot in said foot of said hinge pin in order to remove said door, said flexible locking member of said associated locking apparatus is raised so as to disengage from said blind slot in said foot of said hinge pin, thereby allowing said foot of said hinge pin to be removed.

17. The left and right hand convertible door enclosure of claim 10, wherein said door selectively closes said open front of said enclosure.

18. The left and right hand convertible door enclsoure of claim 11, wherein said apparatus involves said pair of front corners of said top wall of said enclosure;

wherein said apparatus involves said pair of front corners of said bottom wall of said enclosure;

wherein said apparatus involves said pair of front edges of said pair of side walls of said enclosure, respectively; and wherein said apparatus involves said pair of side edges of said door.

* * * * *